US005732687A

United States Patent [19]

Hashimoto et al.

[11] Patent Number: 5,732,687

[45] Date of Patent: Mar. 31, 1998

[54] EVAPORATIVE FUEL-PROCESSING SYSTEM FOR INTERNAL COMBUSTION ENGINES

[75] Inventors: Akira Hashimoto; Hideo Moriwaki; Shigeto Kashiwabara; Sachito Fujimoto, all of Wako, Japan

[73] Assignee: Honda Giken Kogyo Kabushiki Kaisha, Tokyo, Japan

[21] Appl. No.: 742,902

[22] Filed: Nov. 1, 1996

[30] Foreign Application Priority Data

Nov. 2, 1995 [JP] Japan ..... 7-308591

[51] Int. Cl.[6] ..... F02M 33/04; F02M 33/02

[52] U.S. Cl. ..... 123/520

[58] Field of Search ..... 123/516, 518, 123/519, 520, 198 D

[56] References Cited

U.S. PATENT DOCUMENTS

| | | | |
|---|---|---|---|
| 5,345,917 | 9/1994 | Maruyama et al. | 123/520 |
| 5,355,863 | 10/1994 | Yamanaka et al. | 123/520 |
| 5,355,864 | 10/1994 | Kuroda et al. | 123/520 |
| 5,398,662 | 3/1995 | Igarashi et al. | 123/520 |

FOREIGN PATENT DOCUMENTS 5-195883 8/1993 Japan .

*Primary Examiner*—Thomas N. Moulis

*Attorney, Agent, or Firm*—Nikaido Marmelstein Murray and Oram LLP

[57] ABSTRACT

An evaporative fuel-processing system for an internal combustion engine includes a canister for adsorbing evaporative fuel generated in the fuel tank, a charging passage connecting between the canister and the fuel tank, a purging passage connecting between the canister and the intake system of the engine, an open-to-atmosphere passage for communicating the canister with atmosphere, a charge control valve for selectively opening and closing the charging passage, a purge control valve for selectively opening and closing the purging passage, and a vent shut valve for selectively opening and closing the open-to-atmosphere valve, and a pressure sensor inserted in the charging passage at a location on one side of the charge control valve closer to the fuel tank, for detecting internal pressure within the charging passage. When predetermined conditions are satisfied, the purge control valve is closed and the charge control valve and the vent shut valve are opened. It is determined that the vent shut valve is abnormal when the internal pressure detected by the pressure sensor is below a predetermined negative pressure value while the purge control valve, the charge control valve, and the vent shut valve are in the above respective states.

5 Claims, 5 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which stores evaporative fuel generated in the fuel tank and purges the same into the intake system of the engine when the engine is in a proper operating condition, and more particularly to an evaporative fuel-processing system of this kind, which has a function of determining abnormality in the system.

2. Prior Art

Conventionally, there is known an evaporative fuel-processing system for internal combustion engines, for example, from Japanese Laid-Open Patent Publication (Kokai) No. 5-195883 and U.S. Pat. No. 5,477,842 corresponding thereto, which includes a fuel tank, a canister for adsorbing evaporative fuel generated in the fuel tank, a charging passage connecting between the canister and the fuel tank, a purging passage connecting between the canister and the intake system of the engine, an open-to-atmosphere passage for communicating the interior of the canister with the atmosphere, a charge control valve arranged across the charging passage, for selectively opening and closing the same, a purge control valve arranged across the purging passage, for selectively opening and closing the same, and a vent shut valve arranged across the open-to-atmosphere passage, for selectively opening and closing the same, wherein evaporative fuel stored in the canister is supplied to the engine when the engine is in a proper operating condition. According to the known evaporative-fuel processing system, if pressure within the fuel tank falls below a predetermined value when a command is issued to open the vent shut valve while the purge control valve and the charge control valve are open, it is determined that there is an abnormality that the vent shut valve is kept closed.

According to the proposed system, however, during execution of the abnormality determination as to the vent shut valve, evaporative fuel within the fuel tank is drawn into the intake system to enrich the air-fuel ratio of an air-fuel mixture supplied to the engine, which can result in degraded exhaust emission characteristics and/or degraded drivability.

SUMMARY OF THE INVENTION

It is the object of the invention to provide an evaporative fuel-processing system for internal combustion engines, which is capable of carrying out abnormality determination as to the vent shut valve without causing degraded exhaust emission characteristics and/or degraded drivability.

To attain the above object, the present invention provides an evaporative fuel-processing system for an internal combustion engine having a fuel tank, and an intake system, the evaporative fuel-processing system including a canister for adsorbing evaporative fuel generated in the fuel tank, a charging passage connecting between the canister and the fuel tank, a purging passage connecting between the canister and the intake system of the engine, an open-to-atmosphere passage for communicating the canister with atmosphere, a charge control valve for selectively opening and closing the charging passage, a purge control valve for selectively opening and closing the purging passage, and a vent shut valve for selectively opening and closing the open-to-atmosphere valve, and a pressure sensor inserted in the charging passage at a location on one side of the charge control valve closer to the fuel tank, for detecting internal pressure within the charging passage, the improvement comprising:

diagnosing means responsive to satisfaction of predetermined conditions, for closing the purge control valve and opening the charge control valve and the vent shut valve; and abnormality-determining means for determining that the vent shut valve is abnormal when the internal pressure detected by the pressure sensor is below a predetermined negative pressure value while the diagnosing means is operative.

Preferably, the diagnosing means opens the charge control valve when a predetermined time period has elapsed after closing of the purge control valve.

Also preferably, the abnormality-determining means determines that the vent shut valve is abnormal when the internal pressure detected by the pressure sensor has continued to be below the predetermined negative pressure value over a predetermined time period.

Preferably, the predetermined conditions include at least purging of evaporative fuel from the canister to the intake system of the engine.

In a preferred embodiment of the invention, the evaporative fuel-processing system comprises:

purging means for executing purging of evaporative fuel from the canister to the intake system of the engine by opening the purge control valve and the vent shut valve and closing the charge control valve, when the engine is in a predetermined operating condition;

diagnosing means for closing the purge control valve and opening the charge control valve while keeping the vent shut valve open; and abnormality-determining means for determining that the vent shut valve is abnormal when the internal pressure detected by the pressure sensor is below a predetermined negative pressure value while the diagnosing means is operative after the purging means has operated.

The above and other objects, features, and advantages of the invention will be more apparent from the following detailed description taken in conjunction with the accompanying drawings.

BRIEF DESCRIPTION OF THE DRAWINGS

FIGS. 4A to 4D collectively show a timing chart useful in explaining a method of abnormality determination in the open-to-atmosphere mode, wherein:

FIG. 4A shows an operating pattern of a bypass valve appearing in FIG. 1;

FIG. 4B shows an operating pattern of a vent shut valve appearing in FIG. 1;

FIG. 4C shows an operating pattern of a purge control valve appearing in FIG. 1; and FIG. 4D shows a change in tank internal pressure PTANK with the lapse of time.

DETAILED DESCRIPTION

The invention will now be described in detail with reference to the drawings showing an embodiment thereof.

Figure 1:
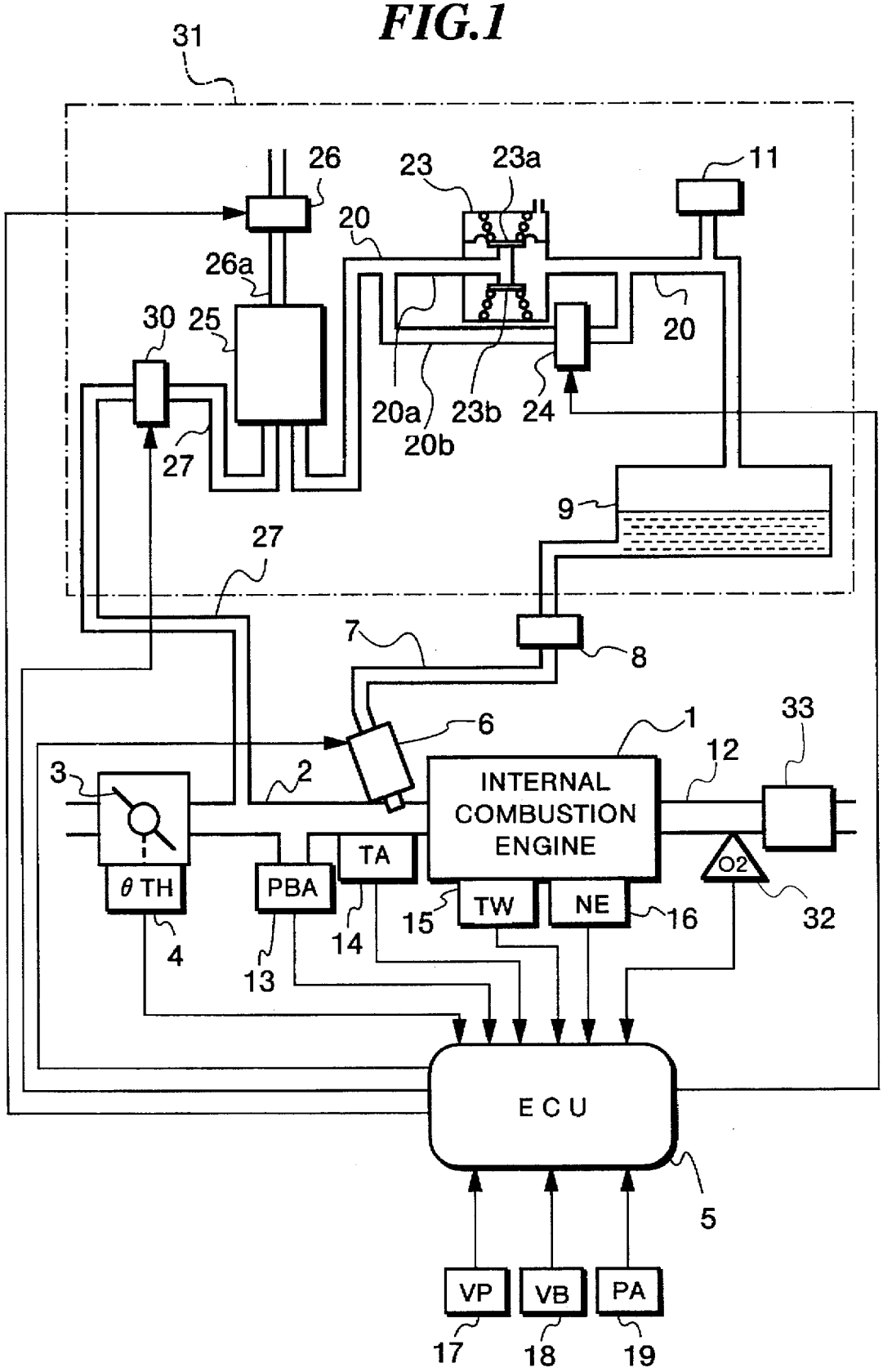
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine, an evaporative emission control system and a control system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH ) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted into a coolant passage formed in the cylinder block, which is filled with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Arranged in an exhaust pipe 12 is an O2 sensor 32 as an exhaust gas component concentration sensor for detecting the concentration VO2 of oxygen present in exhaust gases, and generating a signal indicative of the sensed oxygen concentration to the ECU 5. Further, a three-way catalyst 33 is arranged in the exhaust pipe 12 at a location downstream of the O2 sensor 32, for purifying exhaust gases emitted from the engine 1.

Further electrically connected to the ECU 5 are a vehicle speed sensor 17 for detecting the traveling speed VP of an automotive vehicle in which the engine 1 is installed, a battery voltage sensor 18 for detecting output voltage VB from a battery, not shown, of the engine, and an atmospheric pressure sensor 19 for detecting atmospheric pressure PA, of which respective output signals indicative of the sensed parameter values are supplied to the ECU 5.

Next, an evaporative emission control system (hereinafter referred to as "the emission control system") 31 will be described, which is comprised of the fuel tank 9, a charging passage 20, a canister 25, a purging passage 27, etc.

The fuel tank 9 is connected to the canister 25 via the charging passage 20 which has a bifurcated portion consisting of first and second divided passages **20*a* and 20*b* arranged in an engine compartment, not shown. A tank internal pressure sensor 11 is inserted in the charging passage 20 at a location between the divided passages 20*a* and 20*b* and the fuel tank 9, for detecting pressure PTANK within the charging passage 20**. The pressure PTANK is almost equal to the pressure within the fuel tank, and will therefore be referred to as "the tank internal pressure"hereinafter.

The first divided passage **20*a* is provided with a two-way valve 23 arranged thereacross. The two-way valve 23 is a mechanical valve formed of a positive pressure valve which opens when the tank internal pressure PTANK is higher than the atmospheric pressure by approximately 20 mmHg, and a negative pressure valve which opens when the tank internal pressure PTANK is lower than pressure within the charging passage 20 on a a side of the two-way valve 23 closer to the canister 25** by a predetermined value.

The second divided passage **20*b* is provided with a bypass valve 24 as a charge control valve arranged thereacross, which is a normally-closed electromagnetic valve, and is selectively opened and closed during execution of abnormality determination, described hereinafter, by a signal from the ECU 5**.

The canister 25 contains activated carbon for adsorbing evaporative fuel, and has an air inlet port, not shown, communicating with the atmosphere via a passage **26*a*. Arranged across the passage 26*a* is a vent shut valve 26 which is a normally-open electromagnetic valve and is temporarily closed during execution of the abnormality determination, by a signal from the ECU 5**.

The canister 25 is connected via the purging passage 27 to the intake pipe 2 at a location downstream of the throttle valve 3. The purging passage 27 has a purge control valve 30 arranged thereacross. The purge control valve 30 is an electromagnetic valve which is constructed to continuously change the flow rate of a mixture of evaporative fuel and air as the on/off duty ratio of a control signal from the ECU 5 is changed.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the fuel injection valves 6, bypass valve 24, and purge control valve 30.

The CPU of the ECU 5 operates in response to the above-mentioned various engine parameter signals from the various sensors to determine operating conditions in which the engine 1 is operating, such as an air-fuel ratio feedback control region where the air-fuel ratio is controlled in response to the oxygen concentration in exhaust gases detected by the O2 sensor 32, and air-fuel ratio open-loop control regions, and calculates, based upon the determined engine operating conditions, a fuel injection period Tout over which the fuel injection valve 6 is to be opened, in synchronism with generation of TDC signal pulses, by the use of the following equation (1):

$$Tout=Ti\times K1\times KO2+K2 \quad (1)$$

where Ti represents a basic value of the fuel injection period Tout of the fuel injection valves 6, which is read from a Ti map determined according to the engine rotational speed NE and the intake pipe absolute pressure PBA.

KO2 represents an air-fuel ratio correction coefficient which is determined based on the concentration of oxygen present in exhaust gases detected by the O2 sensor 32 when the engine 1 is operating in the air-fuel ratio feedback control region, while it is set to predetermined values corresponding to the respective operating regions of the engine when the engine 1 is in the air-fuel ratio open-loop control regions.

K1 and K2 represent other correction coefficients and correction variables, respectively, which are set according to engine operating parameters to such values as optimize engine operating characteristics, such as fuel consumption and engine accelerability.

The abnormality determination of the emission control system 31 is carried out by the CPU of the ECU 5.

Figure 2A:
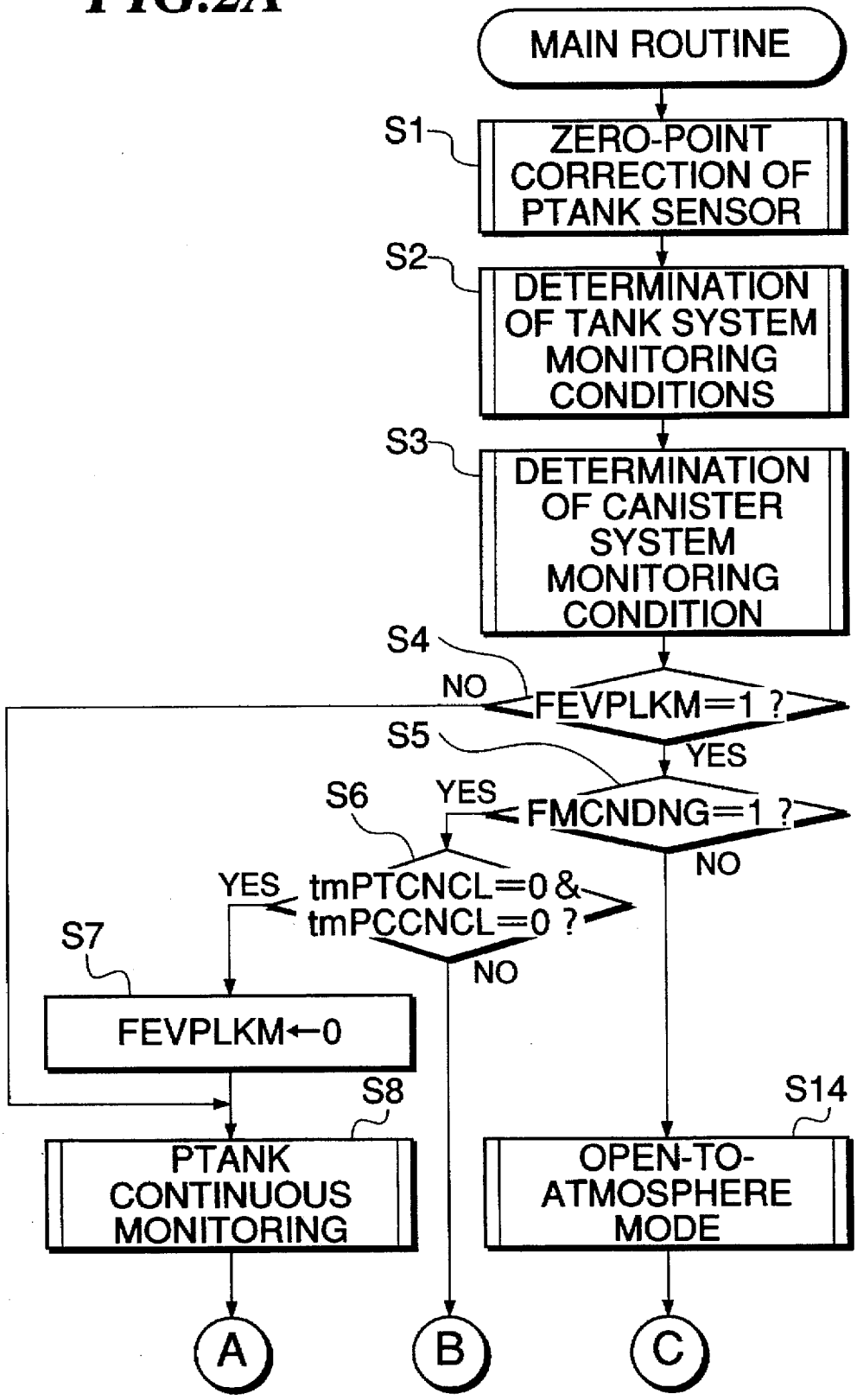
FIG. 2A is a flowchart showing a main routine for carrying out abnormality determination of an evaporative emission control system appearing in FIG. 1.
Figure 2B:
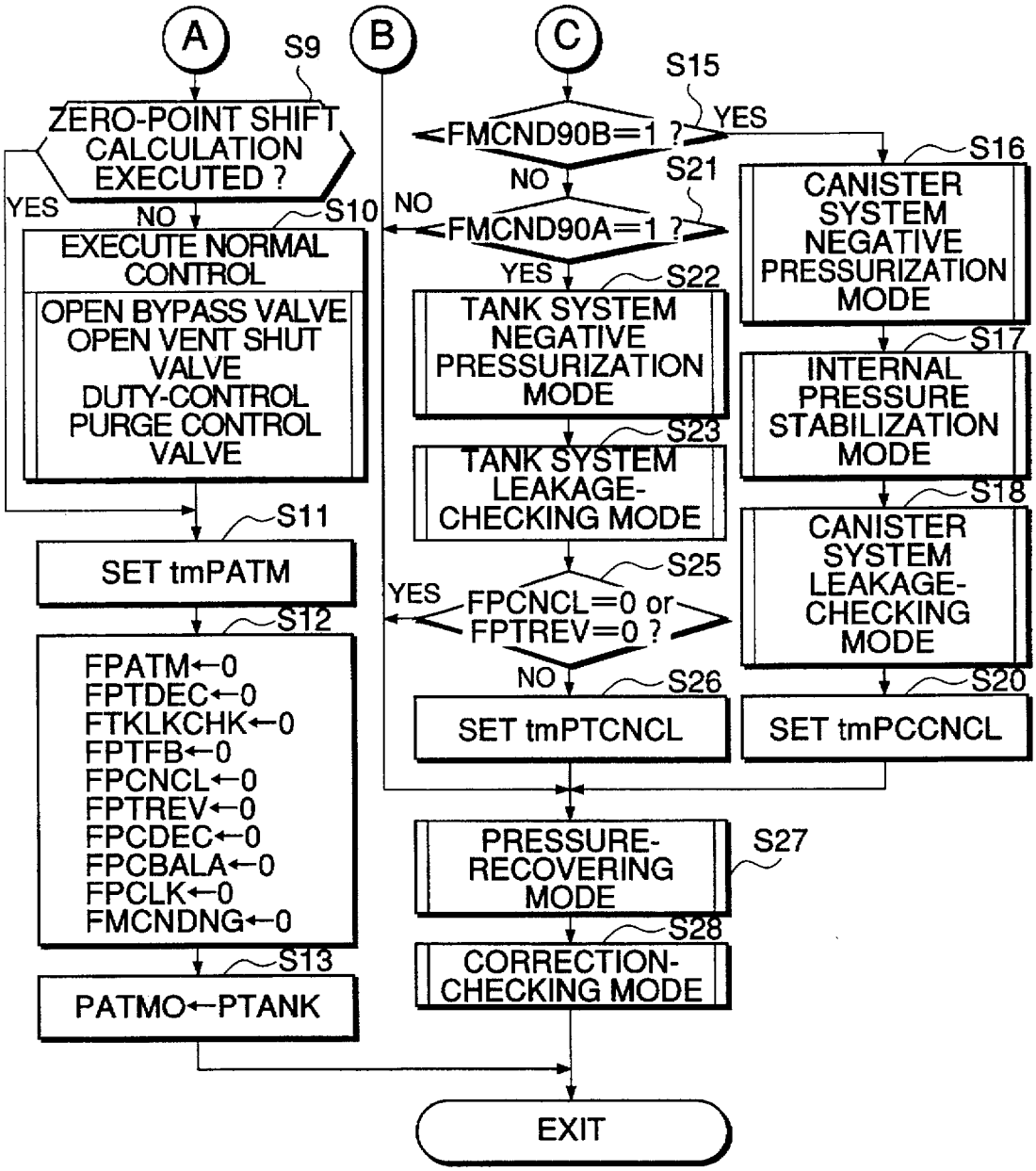
FIG. 2B shows a continued part of the flowchart of FIG. 2A.

FIGS. 2A and 2B show a main routine for carrying out the abnormality determination, which is executed at predetermined time intervals (e.g. 80 msec).

First, at a step S1, zero-point correction of the pressure sensor (PTANK sensor) 11 is carried out. More specifically, at the start of the engine, when the intake air temperature TA and the engine coolant temperature TW are within respective predetermined ranges and at the same time the difference between the two values TA and TW is small (in a so-called cold starting of the engine), the vent shut valve 26 is opened, the purge control valve 30 is closed, and the bypass valve 24 is opened from its closed position. Then, the zero-point correction of the output value from the sensor 11 is carried out based on a change in an output from the pressure sensor 11 which is caused by the above opening of the bypass valve 24 form its closed position.

At a step S2, it is determined whether or not tank system monitoring conditions (preconditions for permitting abnormality determination as to a tank system) are satisfied. The tank system is defined as a part of the emission control system 31 located on one side of the bypass valve 24 closer to the fuel tank 9. A canister system, referred to hereinbelow, is defined as a part of the emission control system 31 located on one side of the bypass valve 24 closer to the canister 25. The tank system monitoring conditions are satisfied, for example, when purging is being carried out with the purge control valve 30 opened, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the tank system monitoring conditions are satisfied, a tank system monitoring permission flag FMCND90A and a monitoring permission flag FEVPLKM are both set to "1", whereas if the tank system monitoring conditions are not satisfied, the tank system monitoring permission flag FMCND90A is set to "0". The monitoring permission flag FEVPLKM is set to "1" if canister system monitoring conditions, referred to hereinafter, are satisfied. While the canister system is being monitored, the tank system monitoring conditions are set unsatisfied.

At a step S3, it is determined whether or not the canister system monitoring conditions (preconditions for permitting abnormality determination as to the canister system) are satisfied. The canister system monitoring conditions are satisfied, similarly to the tank system monitoring conditions, when purging is being carried out, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the canister system monitoring conditions are satisfied, a canister system monitoring permission flag FMCND90B and the monitoring permission flag FEVPLKM are both set to "1", whereas if the canister system monitoring conditions are not satisfied, the canister system monitoring permission flag FMCND90B is set to "0". The monitoring permission flag FEVPLKM is set to "1" if the tank system monitoring conditions are satisfied. While the tank system is being monitored, the canister system monitoring conditions are set unsatisfied.

At a step S4, it is determined whether or not the monitoring permission flag FEVPLKM is equal to "1". If FEVPLKM=0 holds, which means that the tank system monitoring conditions and the canister system monitoring conditions are both unsatisfied, the program proceeds to a step S8, wherein tank internal pressure PTANK continuous monitoring processing is carried out.

In the continuous monitoring processing, if an average value of the tank internal pressure PTANK is held at a value close to the atmospheric pressure while the tank internal pressure PTANK has a small change, it is determined that there is an abnormality in the tank system. This method of determination is based on the fact that when the tank system is normal, the tank internal pressure PTANK tends to be higher than the atmospheric pressure by a predetermined value or more or to be lower than the atmospheric pressure by a predetermined value or more. This determination is carried out after completion of the zero-point correction of the pressure sensor 11, under a normal control mode in which the bypass valve 24 is closed, the vent shut valve 26 is open, and the purge control valve 30 is duty-controlled, as set at a step S10.

Then, the program proceeds to a step S9 in FIG. 2B, wherein it is determined whether or not a calculation of a zero-point shift of the pressure sensor 11 is being executed. During execution of the calculation of the zero-point shift of the pressure sensor 11, the bypass valve 24 is opened and the purge control valve 30 is closed (while the vent shut valve 26 is open), and therefore the program skips the step S10 to a step S11. On the other hand, if the calculation is not being carried out, the program proceeds to the step S10, wherein the normal control mode is set, that is, the bypass valve 24 is closed, the vent shut valve 26 is opened, and the purge control valve 30 is duty-controlled, to thereby control an amount of evaporative fuel to be supplied to the intake system 2 of the engine 1.

Figure 3:
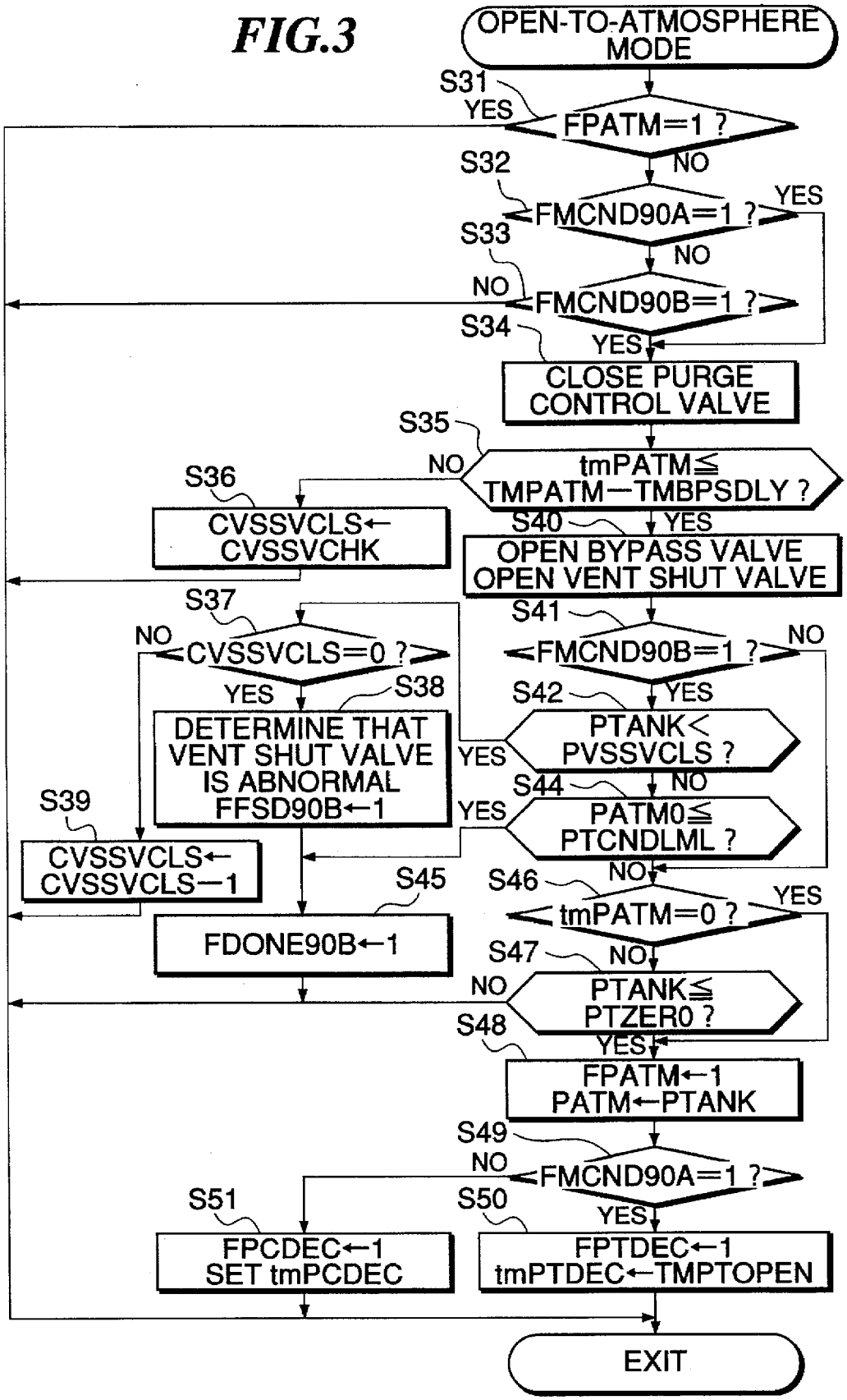
FIG. 3 is a flowchart showing a subroutine for carrying out open-to-atmosphere mode processing, which is executed at a step S14 in FIG. 2A.

At the step S11, an open-to-atmosphere timer (down-counting timer) tmPATM for controlling the maximum time period of open-to-atmosphere mode processing, shown in FIG. 3, is set to a predetermined time period TPATM (e.g. 15 sec) and started.

At a step S12, the following various flags to be used in the present processing are reset. That is, an open-to-atmosphere flag FPATM which, when set to "1", indicates that the open-to-atmosphere mode has been completed, is set to "0". A tank system negative pressurization mode flag FPTDEC which, when set to "1", indicates that tank system negative pressurization mode processing (at a step S22) is to be carried out, is set to "0". A tank system leakage-checking mode flag FTKLKCHK which, when set to "1", indicates that tank system leakage-checking mode processing (at a step S23) is to be carried out, is set to "0". A feedback negative pressurization permission flag FPTFB which, when set to "1", indicates that feedback negative pressurization in the tank system negative pressurization mode is permitted, is set to "0". A pressure-recovering mode flag FPCNCL which, when set to "1", indicates that pressure recovering mode processing (at a step S27) is to be carried out, is set to "0". A correction-checking mode flag FPTREV which, when set to "1", indicates that correction-checking mode processing (at a step S28) is to be carried out, is set to "0". A canister system negative pressurization mode flag FPCDEC which, when set to "1", indicates that canister system negative pressurization mode processing (at a step S16) is to be carried out, is set to "0". An internal pressure stabilization mode flag FPCBALA which, when set to "1", indicates that internal pressure stabilization mode processing (at a step S17) is to be carried out, is set to "0". A canister system leakage-checking mode flag FPCLK which, when set to "1", indicates that canister system leakage-checking mode processing (at a step 518) is to be carried out, is set to "0". Further, a monitoring-stopping flag FMCNDNG which, when set to "1", indicates that the tank monitoring or the canister monitoring is to be stopped during execution of tank monitoring or canister monitoring (i.e. the pressure-recovering mode) is set "0".

At the following step S13, the tank internal pressure PTANK detected in the present loop is stored as initial tank internal pressure PATM0, followed by terminating the present routine.

If the tank system monitoring conditions or the canister system monitoring conditions are satisfied, and hence the monitoring permission flag FEVPLKM is equal to "1" at the step S4, the program proceeds to a step S5, wherein it is determined whether or not the monitoring-stopping flag FMCNDNG is equal to "1". If FMCNDNG=1 holds, it is determined at a step S6 whether or not count values of a tank system pressure-recovering timer (down-counting timer) tmPTCNCL and a canister system pressure-recovering timer (down-counting timer) tmPCCNCL, which are set, respectively, at steps S26 and S20, referred to hereinafter, are both equal to "0". If tmPTCNCL>0 or tmPCCNCL>0 holds, the program proceeds to a step S27. On the other hand, if tmPTCNCCL=0 and tmPCCNCL=0 both hold, the monitoring permission flag FEVPLKM is set to "0"at a step S7, followed by the program proceeding to the step 8.

If FMCNDNG=0 holds at the step S5, which means that the monitoring conditions for the tank system or the canister system are satisfied, the open-to-atmosphere mode processing is executed at a step S14.

FIG. 3 shows a subroutine for carrying out the open-to-atmosphere mode processing.

At a step S31, it is determined whether or not the open-to-atmosphere mode completion flag FPATM is equal to "1". When this question is first made, FPATM =0 holds, and then it is determined at a step S32 whether or not the tank system-monitoring permission flag FMCND90A is equal to "1", and then it is determined at a step S33 whether or the canister system-monitoring permission flag FMCND90B is equal to "1". If FMCND90A=0 and FMCND90B=0 both hold, the program is immediately terminated. On the other hand, if at least one of the two flags FMCND90A and FMCND90B is equal to "1", the program proceeds to a step S34, wherein the purge control valve 30 is closed, and then it is determined at a step S35 whether or not the count value of the open-to-atmosphere timer tmPATM is equal to or smaller than a value (TMPATM–TMBPSDLY), i.e. whether or not a predetermined delay time TMBPSDLY (e.g. 0.5 sec) has elapsed after the start of the present processing. If the answer is negative (NO), i.e. if tmPATM>TMPATM–TMBPSDLY holds, a down-counting timer CVSSVCLS is set to a predetermined value CVSSVCHK (e.g. 3) at a step S36, followed by terminating the present routine.

If the predetermined delay time TMBPSDLY has elapsed after the start of the processing so that the relationship tmPATM≦TMPATM–TMBPSDLY holds, the program proceeds to a step S40, wherein the bypass valve 24 is opened and the vent shut valve 26 is kept open. Then, it is determined at a step S41 whether or not the canister system-monitoring permission flag FMCND90B is equal to "1". If FMCND90B=0 holds, the program jumps to a step S46, whereas if FMCND90B=1 holds, which means that the canister system-monitoring conditions are satisfied, it is determined at a step S42 whether or not the tank internal pressure PTANK is lower than an abnormality-determining reference value PVSSVCLS (e.g. −50 mmHg). The reference value PVSSVCLS is a pressure value indicative of a difference from the atmospheric pressure (−50 mmHg means that the reference value is 50 mmHg lower than the atmospheric pressure), and specific pressure values appearing hereinbelow are similarly indicative of pressure differences from the atmospheric pressure. If PTANK<PVSSVCLS holds, it is determined at a step S37 whether or not the count value of the down-counter CVSSVCLS which has been set at the step S36 is equal to "0". When this question is first made, CVSSVCLS>0 holds, and therefore the count value of the counter is decremented by "1" at a step S38, followed by terminating the present routine.

Thereafter, if PTANK<PVSSVCLS continues to hold so that the count value of the down-counter CVSSVCLS becomes 0, it is determined that there is an abnormality that the vent shut valve 26 is closed although a command has been issued to open the vent shut valve, and then a canister system abnormality flag FFSD90B which, when set to "1", indicates that the canister system undergoes abnormality is set to "1" at a step S38, and then a canister system monitoring termination flag FDONE90B which, when set to "1", indicates that the canister system monitoring is to be terminated is set to "1" at a step S45, followed by terminating the present routine.

On the other hand, if PTANK≧PVSSVCLS holds at the step S42, it is determined at a step S44 whether or not the initial pressure PATM0 stored at the step S13 in FIG. 2B is equal to or lower than a monitoring lower limit value PTCNDLML (e.g. −20 mmHg). If PATM0≦PTCNDLML holds, it is assumed that although the canister system cannot be determined to be abnormal, there is a high possibility that a correct abnormality determination cannot be made, and then the program proceeds to the step S45 to avoid execution of the monitoring. On the other hand, if PATM0>PTCNDLML holds, the program proceeds to a step S46.

At the step S46, it is determined whether or not the count value of the open-to-atmosphere timer tmPATM is equal to "0". When this question is first made, tmPATM>0 holds, and then the program proceeds to a step S47, wherein it is determined whether or not the tank internal pressure PTANK is equal to or lower than a predetermined value PTZERO close to the atmospheric pressure (e.g. +2 mmHg). If PTANK>PTZERO holds, the program is immediately terminated, whereas if PTANK≦PTZERO holds, the program proceeds to a step S48 to terminate the open-to-atmosphere mode. On the other hand, if the predetermined time period TPATM has elapsed after the start of the processing and hence tmPATM =0 holds, the program proceeds from the step S46 to the step S48. The reason why the open-to-atmosphere mode is terminated if PTANK≦PTZERO holds is as follows: That is, it is confirmed at the step S44 that the initial pressure PATM0 is not excessively negative, but it is determined at the step S47 that the tank internal pressure PTANK is not positive. Therefore, the open-to-atmosphere mode need not be carried out and hence is terminated to curtail the time period for executing the monitoring.

At the step S48, the open-to-atmosphere mode completion flag FPATM is set to "1" and the tank internal pressure PTANK obtained at the present time is stored as open-to-atmosphere completion pressure PATM. Then, it is determined at a step S49 whether or not the tank system monitoring permission flag FMCND90A is equal to "1". If FMCND90A=1 holds, the tank system negative pressurization mode flag FPTDEC is set to "1", and a down-counting timer tmPTDEC referred to in the tank system negative pressurization mode (FIG. 2B, step S22) is set to a predetermined time period TMPTOPEN and started at a step S50, followed by terminating the present routine.

On the other hand, if FMCND90A =0 holds, FMCND90B=1 holds, and therefore the canister system negative pressurization mode flag FPCDEC is set to "1", and a down-counting timer tmPCDEC referred to in the canister system negative pressurization mode processing (FIG. 2B, step S16) is set to a predetermined time period TPCDEC and started at a step S51, followed by terminating the present routine.

After execution of the step S48, the answer to the question at the step S31 becomes affirmative (YES), and therefore the present routine is immediately terminated.

As described above, according to the present embodiment, at the start of the open-to-atmosphere mode (at a time point t1 in FIG. 4), the purge control valve 30 is closed, and when the predetermined delay time TMBPSDLY has elapsed from the time point t1 (at a time point t2 in FIG. 4), the bypass valve 24 is opened. Further, if a state in which the tank internal pressure PTANK assumed at the time point t2 is lower than the abnormality-determining reference value PVSSVCLS continues over a predetermined time period corresponding to the predetermined count value CVSSVHK (as indicated by the broken line in FIG. FIG. 4D), it is determined that the vent shut valve 26 is abnormal. Thus, the abnormality determination as to the vent shut valve 26 is carried out with the purge control valve 30 closed, which presents fluctuations in the air-fuel ratio of the air-fuel mixture supplied to the engine 1 and hence makes it possible to carry out the abnormality determination as to the vent shut valve 26 without causing degraded exhaust emission characteristics and degraded drivability.

Figures 4A, 4B, 4C, 4D:
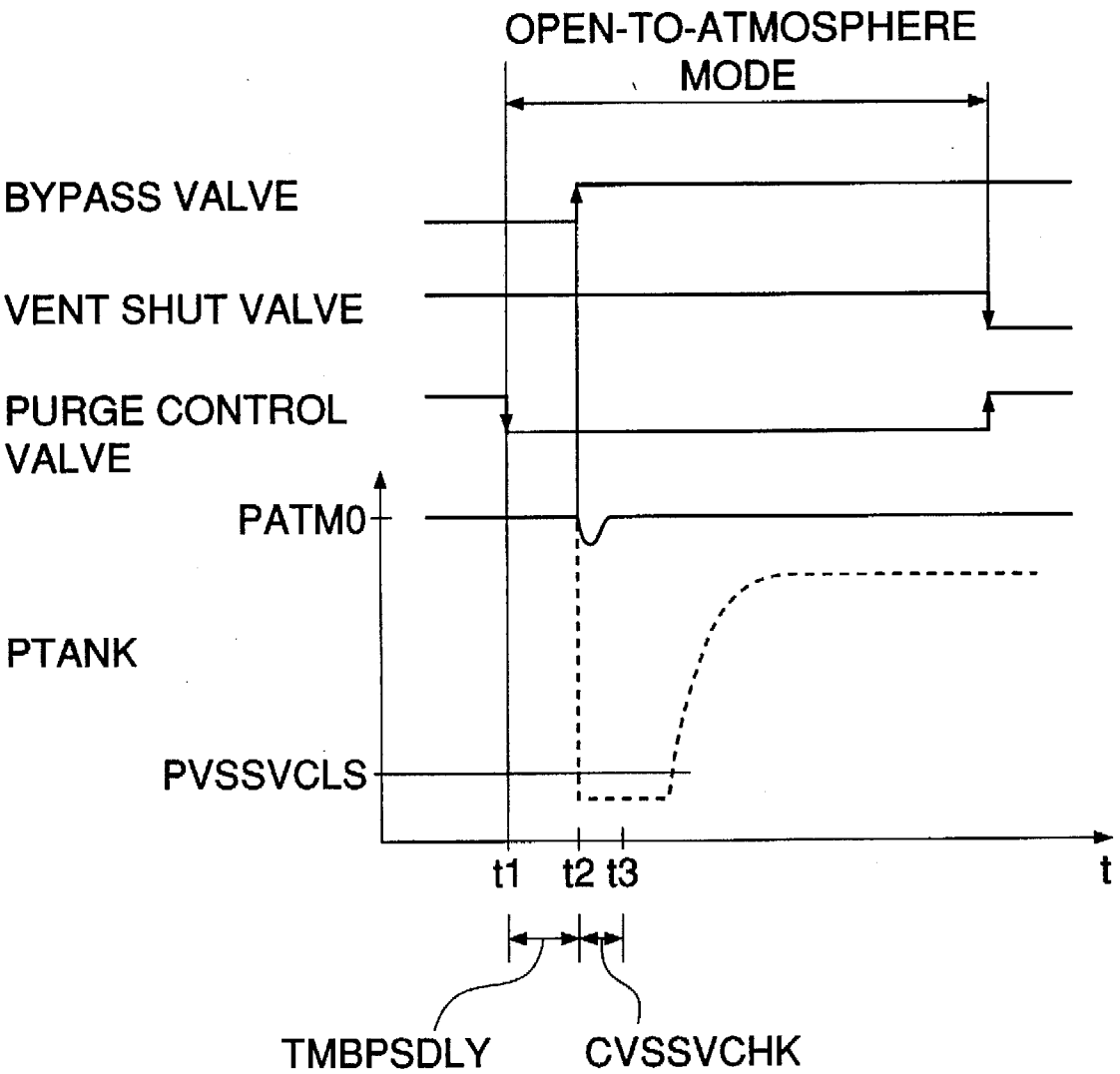

On the other hand, if the vent shut valve 26 is normal, as indicated by the solid line in FIG. 4D, the tank internal pressure PTANK slightly drops immediately after the time point t2 at which the bypass valve 24 is opened, and then the PTANK value quickly recovers to a value close to the initial pressure PATM0.

The reason why the valve opening timing of the bypass valve 24 is delayed relative to the valve closing timing of the purge control valve 30 is as follows: That is, if the purge control valve 30 is closed simultaneously with the valve closing operation of the bypass valve 24, the bypass valve 24 can open first due to an actual time lag between the two valve operations, so that the pressure sensor 11 detects negative pressure, resulting in an erroneous determination that an abnormality occurs in the vent shut valve 26. Further, since the purge control valve 30 is closed first, the canister system is first set into the open-to-atmosphere state. Therefore, by delaying the valve opening operation of the bypass valve 24, the accuracy of the abnormality determination can be improved.

Referring again to FIG. 2B, at a step S15, it is determined whether or not the canister system monitoring flag FMCND90B is equal to "1". If FMCND90B =1 holds, the canister system abnormality determination at the step S16 et seq. is executed.

First, at the step S16, the canister system negative pressurization mode processing is executed. More specifically, the vent shut valve 26 is closed and the purge control valve 30 is duty-controlled while the bypass valve 24 is kept open, to thereby decrease the tank internal pressure PTANK to a predetermined negative value.

At the following step S17, internal pressure stabilization mode processing is executed. More specifically, the bypass valve 24 and the purge control valve 30 are both closed while the vent shut valve 26 is kept closed, and this valve state is kept over a predetermined time period TPCBALA.

Next, the canister system leakage-checking mode processing is executed at a step S18. More specifically, the bypass valve 24 is opened while the vent shut valve 26 and the purge control valve 30 are kept closed. Then, if a decreased amount (PCBALA–PTANK) obtained by subtracting the tank internal pressure PTANK assumed upon the lapse of a predetermined time period TPCLK from the start of the leakage-checking mode from the tank internal pressure PCBALA assumed at the start of the leakage-checking mode is smaller than a predetermined value DPCANI, it is determined that the canister system is abnormal. On the other hand, if the decreased amount (PCBALA–PTANK) becomes larger than the predetermined value DPCANI before the lapse of the predetermined time period TPCLK, it is determined that the canister system is normal, and then the canister system leakage-checking mode processing is immediately terminated. The reason for the above determination is as follows: If the canister system is normal, the pressure within the canister system assumed when the internal pressure stabilization mode is terminated should drop, e.g. to approximately–40 mmHg, and therefore the tank internal pressure PTANK assumed immediately after opening of the bypass valve 24 should drop by an amount larger than the predetermined value DPCANI due to the influence of the dropping of the canister system internal pressure.

At the following step S20, the canister system pressure-recovering timer tmPCCNCL referred to at the step S6 is set to a predetermined time period TPCCNCL (e.g. 0.1 sec) and started, followed by the program proceeding to a step S27.

If FMCND90B=0 holds at the step S15, then it is determined at a step S21 whether or not the tank system monitoring flag FMCND90A is equal to "1". If FMCND90A=0 holds, the program jumps to the step S27, whereas if FMCND90A=1 holds, the tank system abnormality determination at a step S22 et seq. is executed.

First, at the step S22, the tank system negative pressurization mode processing is executed. More specifically, similarly to the canister system negative pressurization mode, the vent shut valve 26 is closed and the purge control valve 30 is duty-controlled while the bypass valve 24 is kept open, to thereby decrease the tank internal pressure PTANK to a predetermined negative value.

Next, the tank system leakage-checking mode processing is executed at the step S23. More specifically, the bypass valve 24 and the purge control valve 30 are closed while the vent shut valve 26 is kept closed, to thereby detect an increased amount PTVARIB of the PTANK value within a predetermined time period.

At the following step S25, it is determined whether or not the pressure-recovering mode flag FPCNCL or the correction-checking mode flag FPTREV is equal to "1". Until the tank system leakage-checking mode is completed, FPCNL=FPTREV=0 holds, and then the tank system pressure-recovering timer tmPTCNCL is set to a predetermined time period TPTCNCL (e.g. 0.1 sec) and started at a step S26, followed by the program proceeding to the step S27. On the other hand, if the tank system leakage-checking mode is completed, the pressure-recovering mode processing flag FPCNCL is set to "1", followed by the program skipping from the step S25 to the step S27.

At the step S27, the pressure-recovering mode processing is carried out. More specifically, the vent shut valve 26 is opened while the bypass valve 24 is kept open and the purge control valve 30 is kept closed, to thereby introduce atmosphere into the canister system and the tank system. Then, the tank system abnormality determination is carried out based on a manner of change in the tank internal pressure PTANK assumed during this introduction of the atmosphere. When the tank system is thus finally determined to be abnormal or normal, the program is immediately terminated without execution of the correction-checking mode processing. On the other hand, if the final determination cannot be made, the pressure-recovering mode flag FPCNCL is set to "0" and the correction-checking mode flag FPTREV is set to "1", followed by the program proceeding to the correction-checking mode processing.

At the step S28, the correction-checking mode processing is executed. More specifically, the bypass valve 24 is closed while the vent shut valve 26 is kept open and the purge control valve 30 is kept closed, to thereby detect an increased amount PTVARIC in the PTANK value within a predetermined time period. Further, the abnormality determination as to the tank system is executed based on the increased amount PTVARIB detected at the step S23 and the increased amount PTVARIC detected at the present step S28.

After execution of the step S28, the present program is terminated.

The program of FIGS. 2A and 2B is executed at predetermined time intervals after an ignition switch, not shown, of the engine is turned on. However, once the engine is started to execute the above described series of determination processing (from the steps S14 to S28) and an abnormality or a normality of the emission control system is finally determined, the abnormality determination is not carried out. Thereafter, when the engine is stopped and then started again, the above series of processing are executed again. That is, the abnormality determination processing is executed once over one operation period from the time the ignition switch is turned on to start the engine to the time the engine is stopped. In the present embodiment, if a determination that the system is abnormal is consecutively made twice, an alarm lamp, not shown, is lit on to alert the driver.

Although the pressure sensor 11 is arranged in the charging passage 20 as shown in FIG. 1, this is not limitative. Alternatively, the pressure sensor 11 may be arranged in the fuel tank 9.

As described in detail, according to the present embodiment, in a normal purging state where the purge control valve and the vent shut valve are open while the charge control valve is closed, if predetermined negative pressure is detected by the pressure sensor when the purge control valve is closed and the charge control valve is opened, it is determined that the vent shut valve is abnormal. Thus, the abnormality determination as to the vent shut valve can be carried out with the purge control valve closed, to thereby maintain good exhaust emission characteristics and/or good drivability.

What is claimed is:

1. In an evaporative fuel-processing system for an internal combustion engine having a fuel tank, and an intake system, said evaporative fuel-processing system including a canister for adsorbing evaporative fuel generated in said fuel tank, a charging passage connecting between said canister and said fuel tank, a purging passage connecting between said canister and said intake system of said engine, an open-to-atmosphere passage for communicating said canister with atmosphere, a charge control valve for selectively opening and closing said charging passage, a purge control valve for selectively opening and closing said purging passage, and a vent shut valve for selectively opening and closing said open-to-atmosphere passage, and a pressure sensor inserted in said charging passage at a location on one side of said charge control valve closer to said fuel tank, for detecting internal pressure within said charging passage, the improvement comprising:

diagnosing means responsive to satisfaction of predetermined conditions, for closing said purge control valve and opening said charge control valve and said vent shut valve; and abnormality-determining means for determining that said vent shut valve is abnormal when said internal pressure detected by said pressure sensor is below a predetermined negative pressure value while said diagnosing means is operative.

2. An evaporative fuel-processing system as claimed in claim 1, wherein said diagnosing means opens said charge control valve when a predetermined time period has elapsed after closing of said purge control valve.

3. An evaporative fuel-processing system as claimed in claim 1, wherein said abnormality determining means determines that said vent shut valve is abnormal when said internal pressure detected by said pressure sensor has continued to be below said predetermined negative pressure value over a predetermined time period.

4. An evaporative fuel-processing system as claimed in claim 1, wherein said predetermined conditions include at least purging of evaporative fuel from said canister to said intake system of said engine.

5. In an evaporative fuel-processing system for an internal combustion engine having a fuel tank, and an intake system, said evaporative fuel-processing system including a canister for adsorbing evaporative fuel generated in said fuel tank, a charging passage connecting between said canister and said fuel tank, a purging passage connecting between said canister and said intake system of said engine, an open-to-atmosphere passage for communicating said canister with atmosphere, a charge control valve for selectively opening and closing said charging passage, a purge control valve for selectively opening and closing said purging passage, and a vent shut valve for selectively opening and closing said open-to-atmosphere passage, and a pressure sensor inserted in said charging passage at a location on one side of said charge control valve closer to said fuel tank, for detecting internal pressure within said charging passage, the improvement comprising:

purging means for executing purging of evaporative fuel from said canister to said intake system of said engine by opening said purge control valve and said vent shut valve and closing said charge control valve, when said engine is in a predetermined operating condition;

diagnosing means for closing said purge control valve and opening said charge control valve while keeping said vent shut valve open; and abnormality-determining means for determining that said vent shut valve is abnormal when said internal pressure detected by said pressure sensor is below a predetermined negative pressure value while said diagnosing means is operative after said purging means has operated.

* * * * *